US006165701A

United States Patent [19]

Teramoto et al.

[11] Patent Number: 6,165,701

[45] Date of Patent: Dec. 26, 2000

[54] BASE FILM FOR PHOTOGRAPHIC FILMS

[75] Inventors: Mitsuru Teramoto; Manabu Kimura, both of Matsuyama; Shinya Watanabe, Sagamihara; Koji Furuya, Sagamihara; Kenji Suzuki, Sagamihara, all of Japan

[73] Assignee: Teijin Limited, Osaka, Japan

[21] Appl. No.: 08/970,388

[22] Filed: Nov. 14, 1997

[30] Foreign Application Priority Data

Nov. 14, 1996 [JP] Japan ..... 8-302919
Feb. 24, 1997 [JP] Japan ..... 9-038983

[51] Int. Cl.[7] ..... G03C 1/795

[52] U.S. Cl. ..... 430/533; 428/480; 428/213; 528/294; 528/295; 528/272; 430/629

[58] Field of Search ..... 430/629, 533; 428/480, 213; 528/294, 295, 272

[56] References Cited

U.S. PATENT DOCUMENTS

| | | | |
|---|---|---|---|
| 3,875,119 | 4/1975 | Aoki et al. | 528/298 |
| 4,066,624 | 1/1978 | Kawase et al. | 528/173 |
| 4,217,441 | 8/1980 | Bayless | 528/293 |
| 5,496,688 | 3/1996 | Okamoto et al. | 430/500 |

FOREIGN PATENT DOCUMENTS

| | | | |
|---|---|---|---|
| 0 601 501 A1 | 3/1993 | European Pat. Off. | G03C 1/795 |
| 48-40414 | 11/1973 | Japan | G03C 1/78 |
| 50-109715 | 8/1975 | Japan | G03C 1/78 |
| 53-146773 | 12/1978 | Japan | B29D 7/24 |
| 1158426 | 6/1989 | Japan | G03C 1/02 |
| 1244446 | 9/1989 | Japan | G03C 1/76 |
| 2191938 | 7/1990 | Japan | G03C 1/06 |
| 2235937 | 9/1990 | Japan | C08J 5/18 |
| 3237450 | 10/1991 | Japan | G03C 1/035 |
| 8104742 | 4/1996 | Japan | C08G 63/183 |

*Primary Examiner*—Mark F. Huff
*Attorney, Agent, or Firm*—Sughrue, Mion, Zinn, Macpeak & Seas, PLLC

[57] ABSTRACT

A base film for photographic films formed from a copolyester comprising 97 to 100 mol % of 2,6-naphthalenedicarboxylic acid and 0 to 3 mol % of a dicarboxylic acid other than 2,6-naphthalenedicarboxylic acid and (i) 87 to 99.8 mol % of ethylene glycol, 0.2 to 10 mol % of bis[4-(ω-hydroxyalkoxy)phenyl]sulfone and 0 to 3 mol % of a glycol other than ethylene glycol and bis[4-(ω-hydroxyalkoxy)phenyl]sulfone or (ii) 97 to 100 mol % of ethylene glycol, 0 to 3 mol % of a diol other than ethylene glycol and 1 to 7 mol % of an oxycarboxylic acid. This base film has an endothermic peak having a peak top temperature, measured by a differential scanning calorimeter, of 120 to 160° C. and showing an endothermic energy of 0.3 mJ/mg or more.

21 Claims, No Drawings

BASE FILM FOR PHOTOGRAPHIC FILMS

DETAILED DESCRIPTION OF THE INVENTION

This invention relates to a base film for photographic films. More specifically, it relates to a base film for photographic films, which is formed from a copolyester having excellent delamination resistance, anticurl properties, mechanical strength, hue and transparency.

A triacetate film has been used as a base material for a photographic film. This triacetate film involves safety and environmental problems because it uses an organic solvent in its production process and has limitations in mechanical strength and dimensional stability. Therefore, a polyethylene terephthalate film has begun to be used partly as a substitute for the triacetate film in some cases. However, when the polyethylene terephthalate film is stored in a roll form, it remains strongly curled and this curling is hardly removed. In consequence, the film after development is inferior in its handling properties, thereby making it difficult to use it as a base film for photographic films which are generally used in a form of a roll.

As a technology for improving anticurl properties, JP-A 53-146773 (the term "JP-A" as used herein means an "unexamined published Japanese patent application") and JP-A 1-244446 propose modified polyethylene terephthalate films in which attempts have been made to improve water vapor permeation, moisture content and the like. These attempts are effective in suppressing curling, but are not satisfactory because the films have such defects as a reduction in dimensional stability due to moisture absorption and an increase in the deformation of an edge portion of a film due to a fall in glass transition temperature.

Furthermore, a higher level of quality have been increasingly required of photographic films in recent years. For example, a speed-up of winding a roll film at the time of taking pictures and a reduction in the size of a photographic camera are under way, and as a result, photographic films are required to have such properties as excellent anticurl properties even when a film is rolled with a small diameter, excellent dimensional stability when a film is made thin, and the like. Both triacetate films and modified polyethylene terephthalate films cannot meet these requirements and a photographic film having excellent characteristic properties is strongly demanded.

To meet these demands, the application of polyethylene naphthalene dicarboxylate (PEN) to a photographic film is disclosed in JP-B 48-40414 (the term "JP-B" as used herein means an "examined Japanese patent publication") and JP-A 50-109715. These films are satisfactory to some extent in terms of adaptability of mechanical strength and dimensional stability to a reduction in film thickness, but they are not satisfactory in terms of anticurl properties. Further, a polyethylene naphthalene dicarboxylate film is liable to have delamination. Particularly, a roll of a polyethylene naphthalene dicarboxylate film undergoes delamination when it is perforated. In these cases, a delaminated portion of the film is whitened, thereby making it difficult to use it as a base film for photographic films.

JP-A 2-235937 discloses a polyester film made from polyethylene-2,6-naphthalate which contains a component represented by the following formula:

(1)

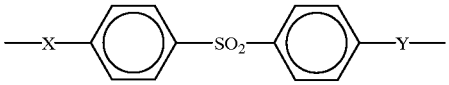

wherein X and Y are a divalent organic group, as a copolymerizable component and which is stretched in at least uniaxial direction. However, the publication is silent about a base film for photographic films. The film of the publication is produced by heat-setting at 200 to 280° C. while it is fixed in length, strained or loosened by 15% or less. It is apparent, however, that it has poor anticurl properties and cannot be used as a base film for photographic films.

JP-A 8-104742 discloses an invention relating to a modified polyester having a glass transition temperature of 125° C. or higher and a calorie value of a crystallization exothermic peak at a temperature fall being 4 J/g or less. It discloses a polyester containing ethylene-2,6-naphthalate as a main constituent unit and 2,2-bis(4'-β-hydroxyethoxyphenyl) propane as a copolymerizable component. However, this publication does not specifically teach copolyethylene-2,6-naphthalene dicarboxylate containing the above copolymerizable component copolymerized. Further, it merely discloses that a biaxially oriented film formed from the modified polyester is produced by stretching an unstretched film to 2.0 to 5.0 times in longitudinal and transverse directions and then heat setting. Apparently, the thus produced biaxially oriented film cannot be used as a base film for photographic films.

U.S. Pat. No. 5,496,688 discloses a base film for photographic films which is made from polyethylene-2,6-naphthalene dicarboxylate. However, this patent fails to disclose 2,2-bis(4'-β-hydroxyethoxyphenyl)propane. It teaches p-oxybenzoic acid and p-oxyethoxybenzoic acid as a copolymerizable component but not a copolyester containing either one of these copolymerized components.

It is an object of the present invention to provide a novel base film for photographic films.

It is another object of the present invention to provide a base film for photographic films, which has excellent delamination resistance, anticurl properties, mechanical strength, hue and transparency.

Other objects and advantages of the present invention will become apparent from the following description.

According to the present invention, firstly, the above objects and advantages of the present invention can be attained by a base film for photographic films (may be referred to as "first base film of the present invention" hereinafter), (A) which is formed from a copolyester comprising:

97 to 100 mol % of 2,6-naphthalenedicarboxylic acid and 0 to 3 molt of a dicarboxylic acid other than 2,6-naphthalenedicarboxylic acid based on the total of all dicarboxylic acid components, and 87 to 99.8 mol % of ethylene glycol, 0.2 to 10 molt of bis[4-(ω-hydroxyalkoxy)phenyl]sulfone represented by the following formula (1):

(1)

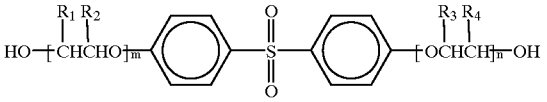

wherein $R_1$, $R_2$, $R_3$ and $R_4$ are each a hydrogen atom or an alkyl group having 1 to 3 carbon atoms, and m and n are independently an integer of 1 to 5, provided that $R_1$ and $R_2$, or $R_3$ and $R_4$ cannot be an alkyl group having 1 to 3 carbon atoms at the same time, and 0 to 3 mol % of a glycol other than ethylene glycol and the compound represented by the above formula (1), based on the total of all diol components; and (B) which has an endothermic peak having a peak top temperature, measured by a differential scanning calorimeter, of 120 to 160° C. and showing an endothermic energy of 0.3 mJ/mg or more.

According to the present invention, secondly, the above objects and advantages of the present invention can be attained by a base film for photographic films (may be referred to as "second base film of the present invention" hereinafter), (A') which is formed from a copolyester comprising:

97 to 100 mol % of 2,6-naphthalenedicarboxylic acid and 0 to 3 mol % of a dicarboxylic acid other than 2,6-naphthalenedicarboxylic acid based on the total of all dicarboxylic acid components, 97 to 100 mol % of ethylene glycol and 0 to 3 mol % of a diol other than ethylene glycol based on the total of all diol components, and an oxycarboxylic acid represented by the following formula (2) in a proportion of 1 to 7 mol % of the total of all dicarboxylic acid components:

(2)

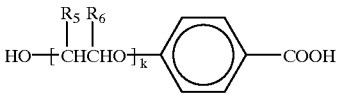

wherein $R_5$ and $R_6$ are each a hydrogen atom or an alkyl group having 1 to 3 carbon atoms, and k is an integer of 0 to 5, provided that $R_5$ and $R_6$ cannot be an alkyl group having 1 to 3 carbon atoms at the same time.

A description is first given of the first base film of the present invention.

The copolyester (A) which is the starting material of the first base film comprises 97 to 100 mol % of 2,6-naphthalenedicarboxylic acid and 0 to 3 mol % of a dicarboxylic acid other than 2,6-naphthalenedicarboxylic acid based on the total of all dicarboxylic acid components.

Illustrative examples of the dicarboxylic acid other than 2,6-naphthalenedicarboxylic acid include oxalic acid, adipic acid, phthalic acid, sebacic acid, dodecanedicarboxylic acid, succinic acid, isophthalic acid, 5-sodium sulfoisophthalic acid, terephthalic acid, 2-potassium sulfoterephthalic acid, 2,7-naphthalenedicarboxylic acid, 1,4-cyclohexanedicarboxylic acid, 4,4'-diphenyldicarboxylic acid, phenylindanedicarboxylic acid and diphenyletherdicarboxylic acid.

The copolyester (A) further comprises 87 to 99.8 mol % of ethylene glycol, 0.2 to 10 mol % of bis[4-(ω-hydroxyalkoxy)phenyl]sulfone represented by the above formula (1) and 0 to 3 mol % of a glycol other than ethylene glycol and the compound represented by the above formula (1), based on the total of all diol components.

In the above formula (1), $R_1$, $R_2$, $R_3$ and $R_4$ are each a hydrogen atom or an alkyl group having 1 to 3 carbon atoms, and m and n are independently an integer of 1 to 5.

Illustrative examples of the alkyl group having 1 to 3 carbon atoms include a methyl, ethyl, n-propyl and isopropyl group. However, $R_1$ and $R_2$, or $R_3$ and $R_4$ cannot be an alkyl group having 1 to 3 carbon atoms at the same time.

Bis[4-(ω-hydroxyalkoxy)phenyl]sulfone of the above formula (1) in which $R_1$, $R_2$, $R_3$ and $R_4$ are each a hydrogen atom is preferred and bis[4-(β-hydroxyethoxy)phenyl]sulfone of the above formula (1) in which $R_1$, $R_2$, $R_3$ and $R_4$ are each a hydrogen atom, and m and n are 1 is more preferred.

When bis(4-hydroxyphenyl)sulfone having no residual ethylene glycol group at both terminals is used as a copolymerizable component, its polymerization reactivity with 2,6-naphthalenedicarboxylic acid is low because the hydroxyl group of bis(4-hydroxyphenyl)sulfone is a phenolic hydroxyl group. Even if it can be polymerized with 2,6-naphthalenedicarboxylic acid, 2,6-naphthalenedicarboxylic acid and bis(4-hydroxyphenyl)sulfone are polymerized without presence of an ethylene glycol component, to form a polymer having incomplete symmetry. In this case, the obtained polymer is inferior to polyethylene-2,6-naphthalene dicarboxylate in symmetry and stiffness.

The proportion of bis[4-(ω-hydroxyalkoxy)phenyl]sulfone component in the copolymer is 0.2 to 10 mol % based on the total of all diol components.

When the proportion of bis[4-(ω-hydroxyalkoxy)phenyl]sulfone is less than 0.2 mol %, delamination resistance cannot be improved because the obtained film has an insufficient effect of suppressing planar orientation. On the other hand, when the proportion is more than 10 mol %, delamination resistance can be improved, but the base film has unsatisfactory mechanical strength or is colored markedly. In the case where the base film is colored markedly, when a dye is added to the base film to provide light piping prevention properties, optical density must be increased to a level more than required for making it uniform over an entire visible light range, whereby transparency is lost disadvantageously.

The proportion of bis[4-(ω-hydroxyalkoxy)phenyl]sulfone is preferably more than 3.0 mol % but 8 mol % or less.

Further, illustrative example of the glycol other than ethylene glycol and the compound represented by the above formula (1) include propylene glycol, 1,2-propanediol, 1,3-propanediol, 1,3-butanediol, 1,4-butanediol, 1,5-pentanediol, 1,6-hexanediol, 1,2-cyclohexane dimethanol, 1,3-cyclohexane dimethanol, 1,4-cyclohexane dimethanol, p-xylylene glycol, addition product of bisphenol A with ethylene oxide, diethylene glycol, triethylene glycol, polyethylene oxide glycol, polytetramethylene oxide glycol, neopentyl glycol and the like.

The copolyester (A) is particularly preferably a copolyester comprising a dicarboxylic acid component other than 2,6-naphthalenedicarboxylic acid and a glycol component other than ethylene glycol and a compound represented by the above formula (1) in a total proportion of 3 mol % or less.

The copolyester (A) may be a copolyester in which part or all of hydroxyl groups and/or carboxyl groups at terminals are blocked with a monofunctional compound such as benzoic acid and methoxypolyalkylene glycol, or a copolyester which is modified with an extremely small amount of an ester-forming compound having 3 or more functional groups, such as glycerin or pentaerythritol within limits that a substantially linear polymer can be obtained.

The copolyester (A) preferably shows a glass transition point (glass transition temperature), measured by a differential scanning calorimeter (DSC), of lower than 125° C. When the glass transition point is lower than 125° C., a film having excellent strength can be obtained advantageously.

The first base film of the present invention is formed from the above-described copolyester (A) and has an endothermic peak having a peak top temperature, measured by a differential scanning calorimeter, of 120 to 160° C. and showing an endothermic energy of 0.3 mJ/mg or more. This endothermic peak is different from a peak showing crystal melting heat. The peak top temperature is preferably in the range of 130 to 150° C. The endothermic energy of the endothermic peak is preferably in the range of 0.5 to 5 mJ/mg. A film having an endothermic temperature and an endothermic energy outside the above ranges is inferior in anticurl properties.

The first base film of the present invention may contain such additives as a stabilizer, ultraviolet absorber, dye, flame retardant and the like.

A dye is preferably contained in the first base film of the present invention to provide light piping prevention properties. Preferably, the dye has heat resistant, compatibility and sublimation resistance at the same time, is inactive with a silver halide emulsion and does not have an adverse influence on photographic performance such as sensitivity and gamma.

The dye is preferably selected from the group consisting of red dyes (having a maximum absorption wavelength of 500 to 600 nm), green dyes (having a maximum absorption wavelength of 600 to 700 nm) and blue dyes (having a maximum absorption wavelength of 600 to 680 nm). The dye is more preferably obtained by blending a red dye and a green dye in a suitable ratio or a red dye and a blue dye in a suitable ratio. The blending ratio of the dye which differs by each dye is preferably 0.005 to 0.1% by weight based on the copolyester from viewpoints of transparency and light piping prevention properties.

The above red dyes, green dyes and blue dyes are preferably selected from anthraquinone-based dyes, triphenyl methane-based dyes, nitro dyes, stilbene dyes, indigoid dyes, thiazine dyes and azo dyes.

A biaxially oriented polyester film formed from polyethylene-2,6-naphthalene dicarboxylate is a more yellowish film than a conventional TAC or polyethylene terephthalate film. Coloration to the film by a dye for imparting light piping prevention properties is preferably carried out in such a manner that uniform optical density is achieved over an entire visible light range. For this purpose, a dye obtained by blending a red dye, green dye and blue dye in a suitable ratio is preferably used to color the film.

The first base film of the present invention can contain a small amount of inert fine particles to provide slipperiness to the film.

The inert fine particles are contained in the copolyester (A). Illustrative examples of the inert fine particles include inorganic particles such as silica spherical particles, calcium carbonate particles, barium sulfate particles, alumina particles, zeolite particles and kaolin particles; and organic particles such as silicone resin particles and crosslinked polystyrene particles. The inorganic particles are preferably synthetic products rather than natural products and may be in any crystal form.

The inert fine particles preferably have an average particle diameter of 0.05 to 1.5 μm. When the average particle diameter of the inert fine particles is less than 0.05 μm, the slipperiness, chipping resistance or wind-up properties of the resulting film are not so improved and when the average particle diameter is larger than 1.5 μm, the transparency of the resulting film degrades disadvantageously. The content of the inert fine particles is preferably 0.001 to 0.2% by weight.

When the inert fine particles are inorganic particles, the content of the inert fine particles is preferably 0.001 to 0.1% by weight, more preferably 0.002 to 0.05% by weight.

When the inert fine particles are silicone resin particles, the content is preferably 0.001 to 0.1% by weight, more preferably 0.001 to 0.02% by weight, particularly preferably 0.001 to 0.01% by weight.

Further, when the inert fine particles are crosslinked styrene particles, the content is preferably 0.001 to 0.05% by weight.

When the amount of the inert fine particles added is below the above range, the slipperiness of the resulting film is insufficient, while when the amount is beyond the above range, transparency is unsatisfactory with an increase in film haze disadvantageously.

The time for the addition of the inert fine particles is any time before the copolyester (A) is formed into a film, for example, during polymerization or before the formation of a film.

The first base film of the present invention can be advantageously produced by a conventional method, for example, by biaxially stretching an unstretched film obtained by extruding the copolyester (A) through an I or T die, and then heat-setting and annealing (heat treating) the stretched biaxially oriented film.

Although the drawing method may be a known method, the stretch temperature is preferably 80 to 140° C. and the stretch ratio is preferably 1.5 to 5.0 times, more preferably 2.5 to 4.0 times in the longitudinal direction, and 2.5 to 5.0 times, more preferably 2.8 to 4.0 times in the transverse direction. The stretched film is heat set at 170 to 260° C., preferably 180 to 250° C. for 1 to 100 sec.

Stretching can be carried out with a commonly used method such as a method by roll or stenter. The film may be stretched in longitudinal and transverse directions simultaneously or consecutively. However, when the proportion of bis[4-(ω-hydroxyalkoxy)phenyl]sulfone component as a copolymerizable component is increased, the resulting film becomes more amorphous. Therefore, in order to prevent a reduction in the Young's modulus of the resulting film and maintain the flatness of the film, it is preferred to lower the heat setting temperature as this copolymerizable component increases.

Annealing (heat treatment) is preferably carried out at 100 to 115° C. for 10 minutes to 100 hours, more preferably 1 to 30 hours.

A description is subsequently given of the second base film of the present invention.

The copolyester (A') which is the starting material of the second base film comprises 97 to 100 mol % of 2,6-naphthalenedicarboxylic acid and 0 to 3 mol % of a dicarboxylic acid other than 2,6-naphthalenedicarboxylic acid based on the total of all dicarboxylic acid components.

Examples of the dicarboxylic acid other than 2,6-naphthalenedicarboxylic acid are the same as those listed for the copolyester (A) of the first base film.

The copolyester (A') further comprises 97 to 100 mol % of ethylene glycol and 0 to 3 mol % of a glycol other than ethylene glycol based on the total of all diol components. Examples of the glycol other than ethylene glycol are the same as those listed for the copolyester (A). The glycol is preferably diethylene glycol.

The copolyester (A') further contains an oxycarboxylic acid represented by the above formula (2) in a proportion of 1 to 7 mol % of the total of all dicarboxylic acid components as a copolymerizable component.

In the above formula (2), $R_5$ and $R_6$ are each a hydrogen atom or an alkyl group having 1 to 3 carbon atoms, and k is an integer of 0 to 5, provided that $R_5$ and $R_6$ cannot be an alkyl group having 1 to 3 carbon atoms at the same time.

Illustrative examples of the alkyl group having 1 to 3 carbon atoms include a methyl, ethyl, n-propyl and isopropyl group.

The oxycarboxylic acid is preferably an oxycarboxylic acid of the above formula (2) in which $R_5$ and $R_6$ are each a hydrogen atom or an oxycarboxylic acid of the above formula (2) in which k is 0.

When the proportion of the oxybenzoic acid is less than 1 mol % of the total of all dicarboxylic acid components, the delamination resistance of the film is not improved, while when the proportion is more than 7 mol %, the crystallinity of the film is lost, whereby mechanical strength and anticurl properties become inferior.

The proportion of the oxybenzoic acid is preferably more than 3.0 mol % but 6.5 mol % or less.

The copolyester (A') is preferably a copolyester comprising a dicarboxylic acid other than 2,6-naphthalenedicarboxylic acid and a glycol other than ethylene glycol in a total proportion of 3 mol % or less. When the total proportion of these substances is more than 3 mol %, their effect of improving the delamination resistance of the resulting film is large but crystallinity is lost, thereby greatly reducing mechanical strength.

Although the copolyester (A') in the present invention is substantially linear, it may contain a polycarboxylic acid having 3 or more functional groups or polyhydroxy compound such as trimellitic acid or pentaerythritol within limits not prejudicial to the effect of the present invention, for example, in a proportion of 2 mol % or less of the total of all acid components.

Preferably, the copolyester (A') has a glass transition point (glass transition temperature), measured by a differential scanning calorimeter, of lower than 125° C. When the glass transition point is lower than 125° C., the resulting film has excellent strength advantageously.

The second base film of the present invention is formed from the above copolyester (A') and has preferably an endothermic peak having a peak top temperature, measured by a differential scanning calorimeter, of 120 to 160° C. and showing an endothermic energy of 0.3 mJ/mg or more. This endothermic peak is different from a peak showing crystal melting heat. The peak top temperature is preferably in the range of 130 to 150° C. The endothermic energy of the endothermic peak is preferably in the range of 0.5 to 5 mJ/mg.

A film having an endothermic peak temperature and an endothermic energy outside the above ranges is inferior in anticurl properties.

The second base film of the present invention may contain such additives as a stabilizer, ultraviolet absorber, dye, flame retardant and the like.

It should be understood that a description of additives for the first base film can be directly applied to the second base film. The second base film can be produced in the same manner as the first base film.

Preferably, the base film of the present invention (including both the first and second base films) has a film thickness of 40 to 120 $\mu$m.

When the thickness of the film is smaller than 40 $\mu$m, the mechanical strength of the film may be insufficient and the flexural strength may lower, whereby the deflection of the film when wound to a roll tends to be large, resulting in a bad shape of the roll disadvantageously. On the other hand, when the thickness is larger than 120 $\mu$m, the significance of reducing the thickness of the film is lost disadvantageously.

The thickness of the film is more preferably in the range of 50 to 100 $\mu$m.

The base film of the present invention has a property that it hardly undergoes curling, that is, it has anticurl properties. The properties can be indicated by an ANSI curl value at 80° C. of preferably 40 $m^{-1}$ or less. The temperature of 80° C. is almost equivalent to the maximum temperature at which a photographic film can be used in daily life. When the ANSI curl value is larger than 40 $m^{-1}$, the film is difficult to handle in the development process of a photograph disadvantageously.

Heretofore, the evaluation of the anticurl properties of a photographic film is determined to what extent curling is removed through the development or drying step of an ordinary photographic film. On the other hand, the base film for photographic films of the present invention has a property that it hardly undergoes curling, that is, it has excellent anticurl properties.

The above anticurl properties can be imparted by subjecting a roll film to a heat treatment at a temperature of (Tg−40)° C. to Tg (glass transition point of the copolyester (A) or (A')). This heat treatment time is preferably 0.1 to 1,500 hours from a viewpoint of production efficiency. When the heat treatment temperature is lower than (Tg−40)° C., the heat treatment takes an extremely long time, thereby reducing production efficiency disadvantageously. On the other hand, when the heat treatment temperature is higher than Tg, the anticurl properties degrade with the result that the film is easily curled.

Preferably, the base film of the present invention has a folded line delamination whitening ratio of 5% or less.

Preferably, the base film of the present invention has within the film plane in least one direction of which Young's modulus is 400 to 750 kg/mm$^2$. The Young's modulus in each of two directions which cross each other at right angles, for example, longitudinal and transverse directions, is preferably 400 to 750 kg/mm$^2$, particularly preferably 400 to 700 kg/mm$^2$. When the Young's modulus is larger than 750 kg/mm$^2$, the film may be delaminated or a large amount of chips may be produced when the film is cut or perforated. To obtain a base film having high stiffness, the total (Y MD+Y TD) of a Young's modulus (Y MD) in the longitudinal direction and a Young's modulus (Y TD) in the transverse direction is preferably 800 kg/mm$^2$ or more.

Further, the base film of the present invention preferably has a haze value of 2.0% or less, more preferably 1.5% or less. When the haze value is more than 2.0%, the transparency of the film lowers disadvantageously.

The copolyester (A) and the copolyester (A') which are the starting materials of the base film of the present invention may contain such additives as a pigment, dye, antioxidant, optical stabilizer, light screen and the like as required in limits that do not impair the transparency, surface flatness and thermal stability of the film.

The base film of the present invention is used for photographic films.

Therefore, according to the present invention, there is further provided a photographic film comprising the base film of the present invention and a photosensitive layer formed on the base film.

To form a photosensitive layer on a base film (to be referred to as "support" hereinafter), the base film is generally subjected to a glow treatment, corona treatment or ultraviolet light treatment, a subbing layer is then formed on one side of the treated support and a back layer on the other side, and a photosensitive layer is further formed on the subbing layer. Specifically, this is carried out as follows.

Provision of Subbing Layer

The support was subjected to heat treatment before a subbing layer was coated on the support. The heat treatment was effected on the support(film) around a 30 cm diameter core with its subbing layer side outside.

The coating solution for a subbing layer having the following composition was coated on the treated surface of the support in the coated amount of 10 ml/m$^2$.

Subbing Layer Composition:

| | |
|---|---|
| Gelatin | 1.0 weight part |
| Salicylic acid | 0.3 weight part |
| Formaldehyde | 0.05 weight part |
| p-$C_9H_{19}C_6H_4O(CH_2CH_2O)_{10}H$ | 0.1 weight part |
| Distilled water | 2.2 weight parts |
| Methanol | 96.35 weight parts |

Provision of Back Layer:

The back layer of the following composition was coated on the sides opposite to the sides of the supports.

a) Preparation of a Conductive Fine Particle Dispersion (tin oxide-antimony oxide composite dispersing solution):

230 parts by weight of stannic chloride and 23 parts by weight of antimony trichloride were dissolved in 3,000 parts by weight of ethanol to obtain a homogeneous solution. 1N sodium hydroxide aqueous solution was dropped in the solution until pH of the above solution became 3 to obtain the coprecipitate of colloidal stannic oxide and antimony oxide. The coprecipitate was left standing at 50° C. for 24 hours to obtain a red brown colloidal precipitate.

The red brown colloidal precipitate was separated by centrifugation. Water was added to the precipitate to wash it by centrifugation in order to remove excessive ions. This operation was repeated three times to remove the excessive ions.

200 parts by weight of the colloidal precipitate from which the excessive ions were removed was dispersed once again into 1,500 parts by weight of water, and the dispersion was sprayed into a kiln heated to 600° C., whereby the bluish fine particle powder of the tin-oxide-antimony oxide having the average particle size of 0.1 μm was obtained. The volume resistivity of the particle was 25 Ωcm.

After the mixed solution of 40 parts by weight of the above fine particle power and 60 parts by weight of water was adjusted to pH 7.0 and roughly dispersed with a stirrer, it was dispersed with a horizontal type sand mill (Daino mill manufactured by WILLYA BACHOFENAG) until the staying time became 30 minutes to prepare the prescribed dispersing solution.

b) Preparation and Provision of Backing Layer:

The following composition [A] was coated on the support so as to have a dry layer thickness of 0.3 μm and dried at 115° C. for 60 seconds. The following coating solution for covering [B] was further coated thereon to have a dry layer thickness of 0.1 μm and dried at 115° C. for 3 minutes.

Composition [A]:

| | |
|---|---|
| Above conductive fine particle dispersion | 10 weight parts |
| Gelatin | 1 weight part |
| Water | 27 weight parts |
| Methanol | 60 weight parts |
| Resorcin | 2 weight parts |
| Polyoxyethylene nonylphenyl ether | 0.01 weight part |

Composition [B]:

| | |
|---|---|
| Cellulose triacetate | 1 weight part |
| Acetone | 70 weight parts |
| Methanol | 15 weight parts |
| Dichloromethylene | 10 weight parts |
| p-Chlorophenol | 4 weight parts |
| Silica particle (mean particle size: 0.2 μm) | 0.01 weight part |
| Polysiloxan | 0.005 weight parts |
| $C_{15}H_{31}COOC_{40}H_{81}/C_{50}H_{101}O(CH_2CH_2O)_{16}H$ (8/2 weight ratio, mean particle size: 20 nm, dispersion) | 0.01 weight parts |

Provision of the Light-sensitive Layer:

Subsequently, light sensitive layers having the following compositions were coated on the subbing layer, in order, to form a multi-layer color light-sensitive material.

Composition of Light Sensitive Layers:

Materials used for the light-sensitive layers are classified as follows:

| | | | |
|---|---|---|---|
| ExC: | Cyan coupler | UV: | UV absorber |
| ExM: | Magenta coupler | HBS: | High boiling solvent |
| ExY: | Yellow coupler | H: | Gelatin hardener |
| ExS: | Sensitizing dye | | |

The composition and its amount (g/m$^2$) of each of the layers set forth below. The amount of each component means the coating amount. The values for the silver halide emulsion mean the coating amount of silver. As for the sensitizing dyes, the coating amount per mole of the silver halide in the same layer is shown in terms of mole.

| The first layer (antihalation layer): | |
|---|---|
| Black colloidal silver | 0.18 |
| Gelatin | 1.40 |
| ExM-1 | 0.18 |
| ExF-1 | $2.0 \times 10^{-3}$ |
| HBS-1 | 0.20 |

| The second layer (intermediate layer): | |
|---|---|
| Emulsion G | silver: 0.065 |
| 2,5-Di-t-pentadecylhydroquinone | 0.18 |
| ExC-2 | 0.020 |
| UV-1 | 0.060 |
| UV-2 | 0.080 |
| UV-3 | 0.10 |
| HBS-1 | 0.10 |
| HBS-2 | 0.020 |
| Gelatin | 1.04 |

| The third layer (low-sensitivity red sensitive emulsion layer): | |
|---|---|
| Emulsion A | silver: 0.25 |
| Emulsion B | silver: 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-7 | 0.0050 |
| ExC-8 | 0.010 |
| Cpd-2 | 0.025 |
| HBS-1 | 0.10 |
| Gelatin | 0.87 |

| The fourth layer (middle-sensitivity red sensitive emulsion layer): | |
|---|---|
| Emulsion D | silver: 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.025 |
| ExC-7 | 0.0010 |
| ExC-8 | 0.0070 |
| Cpd-2 | 0.023 |
| HBS-1 | 0.010 |
| Gelatin | 0.75 |

| The fifth layer (high-sensitivity red sensitive emulsion layer): | |
|---|---|
| Emulsion E | silver: 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.12 |
| ExC-3 | 0.045 |
| ExC-6 | 0.020 |
| ExC-8 | 0.025 |
| Cpd-2 | 0.050 |
| HBS-1 | 0.22 |
| HBS-2 | 0.10 |
| Gelatin | 1.20 |

| The sixth layer (Intermediate layer): | |
|---|---|
| Cpd-1 | 0.10 |
| HBS-1 | 0.50 |
| Gelatin | 1.10 |

| The seventh layer (low-sensitivity green sensitive emulsion layer): | |
|---|---|
| Emulsion C | silver: 0.35 |
| ExS-4 | $3.0 \times 10^{-5}$ |
| ExS-5 | $2.1 \times 10^{-4}$ |
| ExS-6 | $8.0 \times 10^{-4}$ |
| ExM-1 | 0.010 |

-continued

| The seventh layer (low-sensitivity green sensitive emulsion layer): | |
|---|---|
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

| The eighth layer (middle-sensitivity green sensitive emulsion layer): | |
|---|---|
| Emulsion D | silver: 0.80 |
| ExS-4 | $3.2 \times 10^{-5}$ |
| ExS-5 | $2.2 \times 10^{-4}$ |
| ExS-6 | $8.4 \times 10^{-4}$ |
| ExM-2 | 0.13 |
| ExM-3 | 0.030 |
| ExY-1 | 0.018 |
| HBS-1 | 0.16 |
| HBS-3 | $8.0 \times 10^{-3}$ |
| Gelatin | 0.90 |

| The ninth layer (high-sensitivity green sensitive emulsion layer): | |
|---|---|
| Emulsion E | silver: 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.030 |
| ExM-4 | 0.040 |
| ExM-5 | 0.019 |
| Cpd-3 | 0.040 |
| HBS-1 | 0.25 |
| HBS-2 | 0.10 |
| Gelatin | 1.44 |

| The tenth layer (yellow filter layer) | |
|---|---|
| Yellow colloidal silver | silver: 0.030 |
| Cpd-1 | 0.16 |
| HBS-1 | 0.60 |
| Gelatin | 0.60 |

| The eleventh layer (low-sensitivity blue sensitive emulsion layer): | |
|---|---|
| Emulsion C | silver: 0.18 |
| ExS-7 | $8.6 \times 10^{-4}$ |
| ExY-1 | 0.020 |
| ExY-2 | 0.22 |
| ExY-3 | 0.50 |
| ExY-4 | 0.020 |
| HBS-1 | 0.28 |
| Gelatin | 1.10 |

| The twelfth layer (middle-sensitivity blue sensitive emulsion layer): | |
|---|---|
| Emulsion D | silver: 0.40 |
| ExS-7 | $7.4 \times 10^{-4}$ |
| ExC-7 | $7.0 \times 10^{-3}$ |
| ExY-2 | 0.050 |
| ExY-3 | 0.10 |
| HBS-1 | 0.050 |
| Gelatin | 0.78 |

| The thirteenth layer (High-sensitivity blue sensitive emulsion layer): | |
|---|---|
| Emulsion F | silver: 1.00 |
| ExS-7 | $4.0 \times 10^{-4}$ |
| ExY-2 | 0.010 |
| ExY-3 | 0.010 |
| HBS-1 | 0.070 |
| Gelatin | 0.86 |

| The fourteenth layer (first protective layer): | |
|---|---|
| Emulsion G | silver: 0.20 |
| UV-4 | 0.11 |
| UV-5 | 0.17 |

-continued

| The fourteenth layer (first protective layer): | |
|---|---|
| HBS-1 | 0.050 |
| Gelatin | 1.00 |

| The fifteenth layer (second protective layer): | |
|---|---|
| H-1 | 0.40 |
| B-1 (diameter: 1.7 μm) | 0.050 |
| B-2 (diameter: 1.7 μm) | 0.10 |
| B-3 | 0.10 |
| S-1 | 0.20 |
| Gelatin | 1.20 |

To each layer, the compounds of W-1 to W-3, B-4 to B-6, F-1 to F-17, an iron salt, a lead salt, a gold salt, a platinum salt, an iridium salt and a rhodium salt were appropriately incorporated, in order to improve preservation performance, processing performance, antipressure performance, antimold and fungicidal performance, antistatic performance, and coating performance.

Emulsion composition used in each layer set forth in Table 1.

TABLE 1

| | mean AgI content (%) | mean grain size (μm) | coefficient of variation (%) | diameter/ thickness | silver ratio [core/middle/shell] (AgI content) | grain structure/ form |
|---|---|---|---|---|---|---|
| A | 4.0 | 0.45 | 27 | 1 | [1/3] (13/1) | double/octahedron |
| B | 8.3 | 0.70 | 14 | 1 | [3/7] (25/2) | double/octahedron |
| C | 2.0 | 0.55 | 25 | 7 | — | even/tabular |
| D | 9.0 | 0.65 | 25 | 6 | [12/59/29] (0/11/8) | triple/tabular |
| E | 9.0 | 0.85 | 23 | 5 | [8/59/33] (0/11/8) | triple/tabular |
| F | 14.5 | 1.25 | 25 | 3 | [37/63] (34/3) | double/tabular |
| G | 1.0 | 0.07 | 15 | 1 | — | even/tabular |

In Table 1;

(1) Emulsions A to F were subjected to a reduction sensitization with thiourea dioxide and thiosulfonic acid in the preparation of the grains according to the examples described in Japanese Patent Laid-open Publication No. 2-191938.

(2) Emulsions A to F were subjected to a gold sensitization, a sulfur sensitization and a selenium sensitization in the presence of the spectral sensitizing dyes described in the respective layers and sodium thiocyanate according to the examples of Japanese Patent Laid-open Publication No.3-237450.

(3) Low molecular weight gelatin was used in the preparation of the tabular grains according to the examples described in Japanese Patent Laid-open Publication No. 1-158426.

(4) The dislocation lines described in Japanese Patent Laid-open Publication No. 3-237450 were observed in the tabular grains and regular crystal grains having a grain structure with a high pressure electron microscope.

The abbreviations of the components used in the respective layers mean the following compounds:

ExC-1
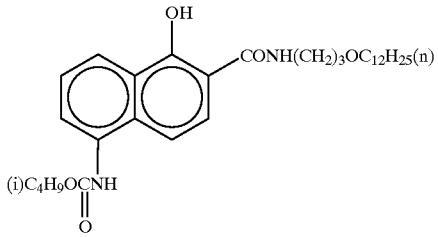
ExC-2
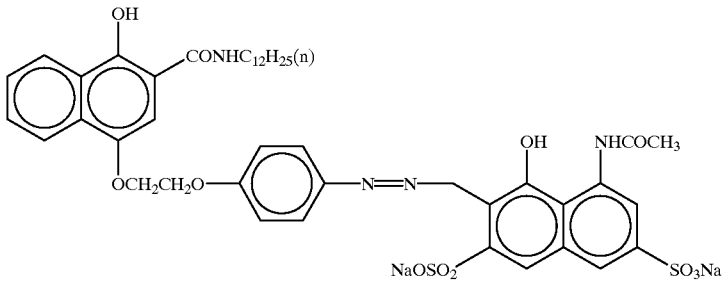
ExC-3
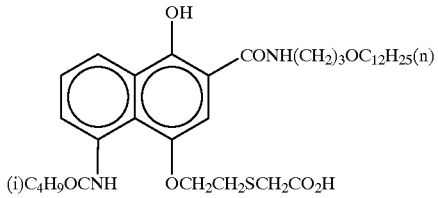
ExC-4
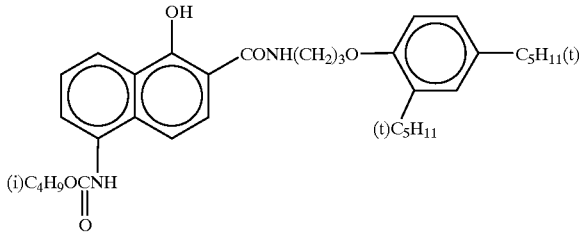
ExC-5
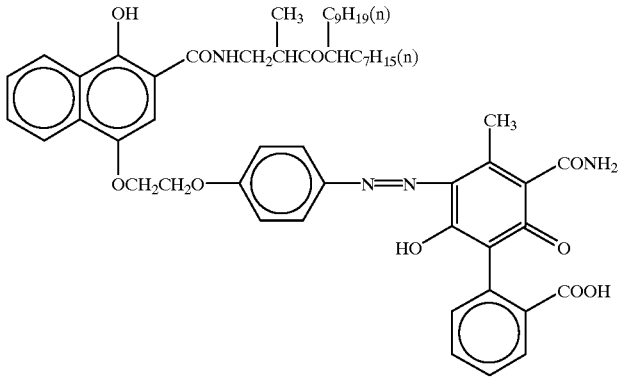
ExC-6
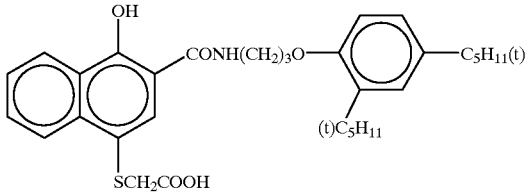

-continued
ExC-7
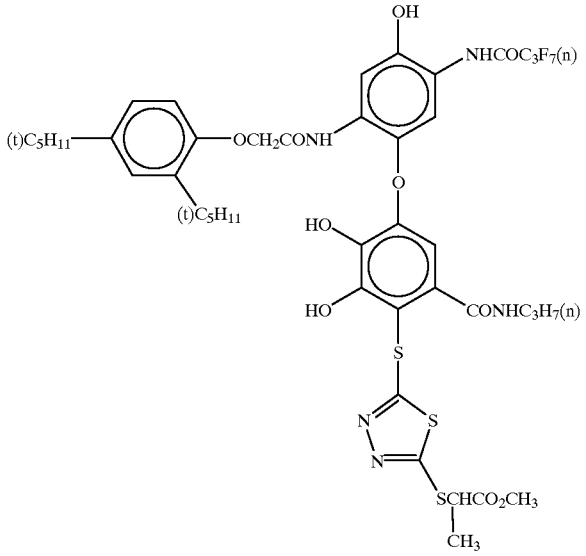
ExC-8
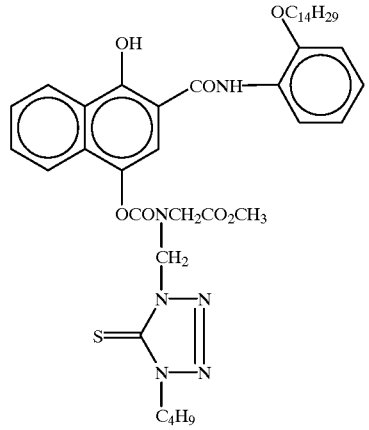
ExM-1
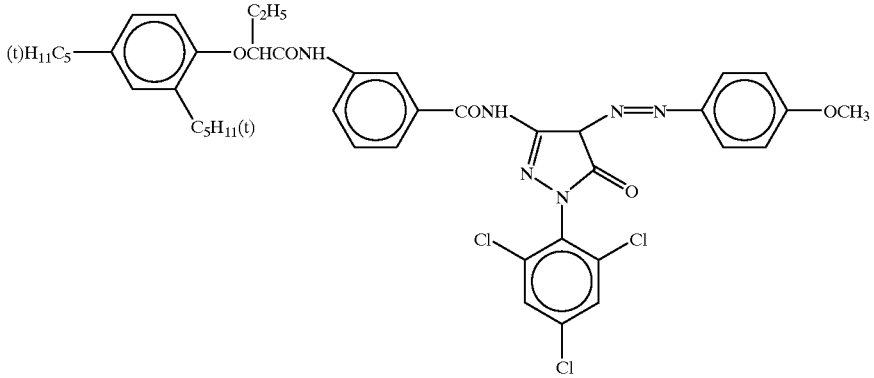

-continued
ExM-2
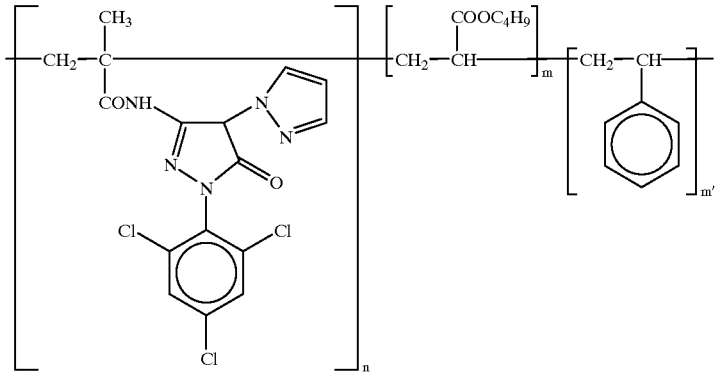
$n$ = 50, $m$ = 25, $m'$, mol. wt. = approx. 20.000
ExM-3
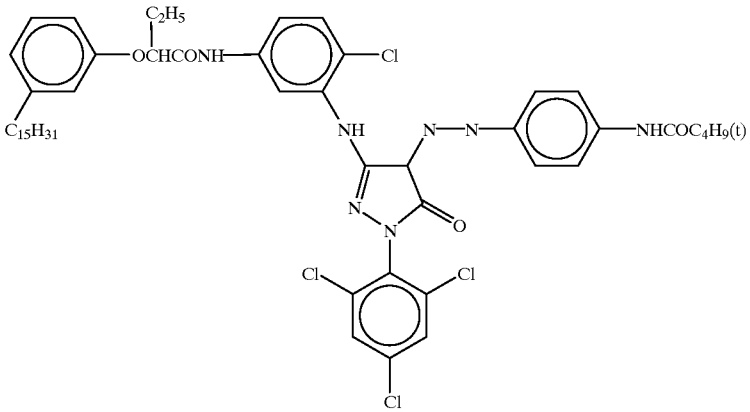
ExM-4
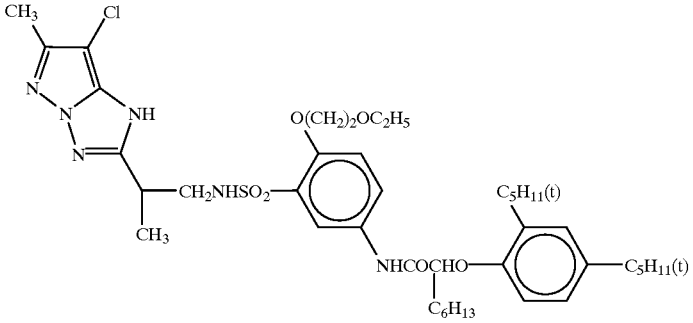
ExM-5
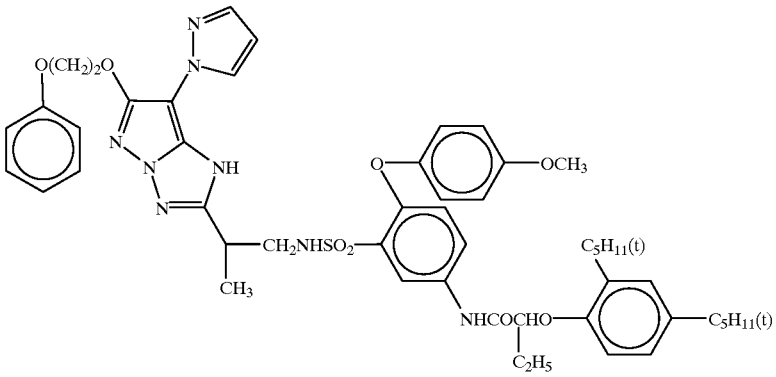

-continued
ExY-1
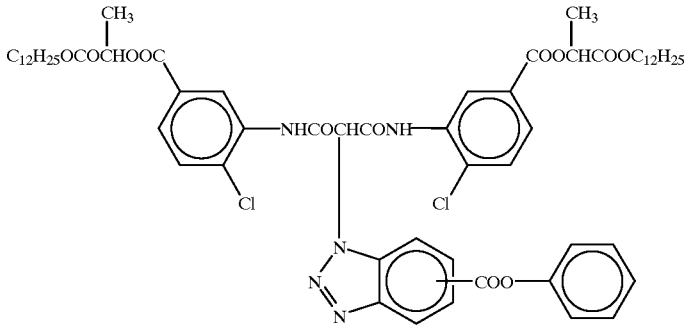
ExY-2
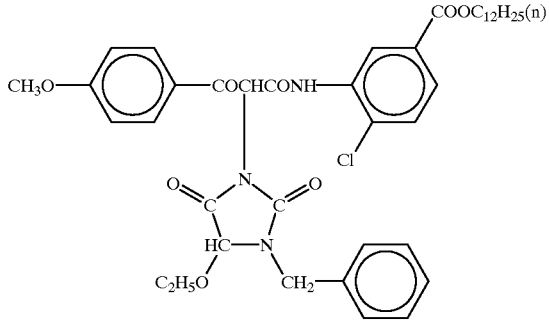
ExY-3
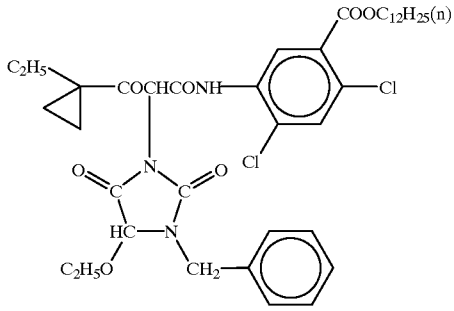
ExY-4
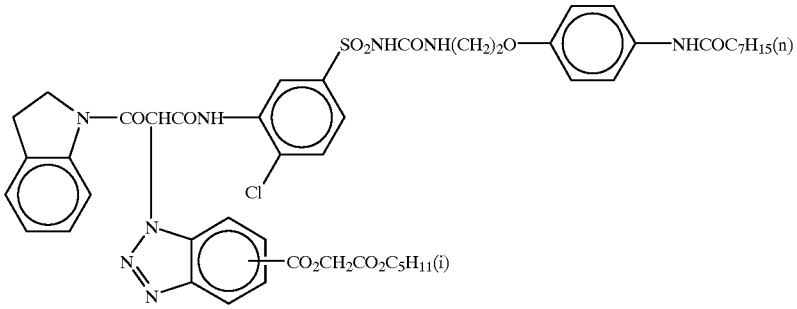
ExF-1
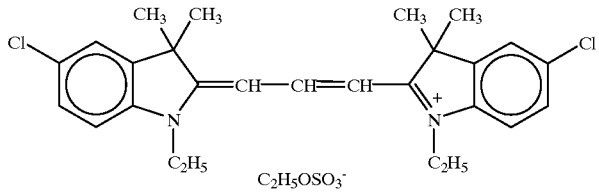

-continued
Cpd-1
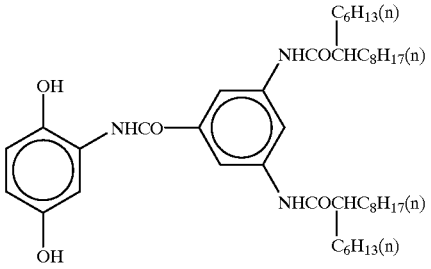
Cpd-2
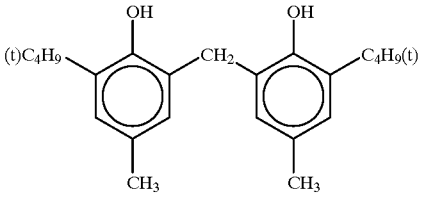
Cpd-3
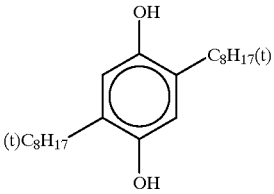
UV-1
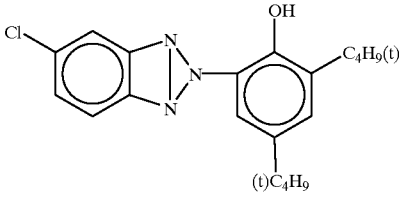
UV-2
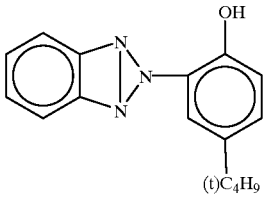
UV-3
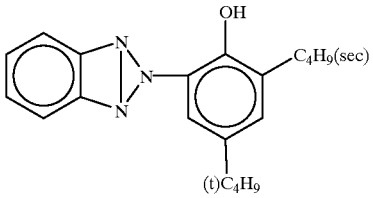
UV-4
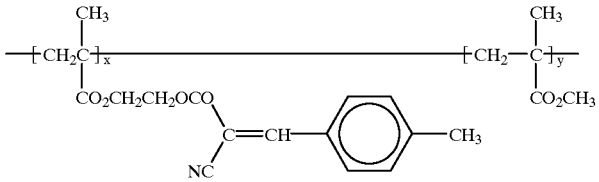
x:y = 70:30 (weight %)
UV-5
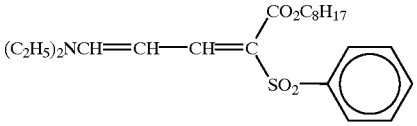
HBS-1
Tricresyl phosphate
HBS-2
Di-n-butyl phthalate
HBS-3
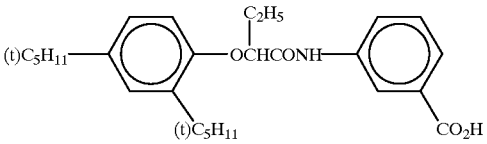
ExS-1
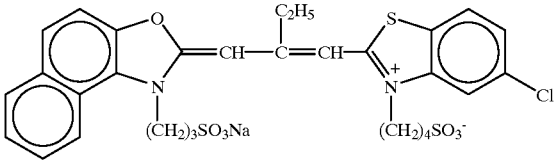

-continued
ExS-2
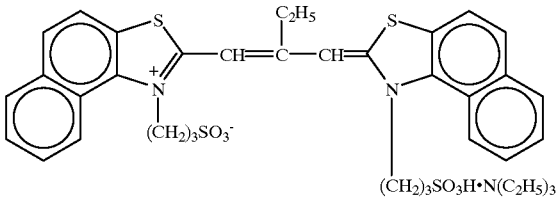
ExS-3
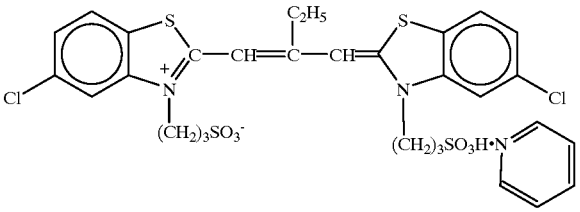
ExS-4
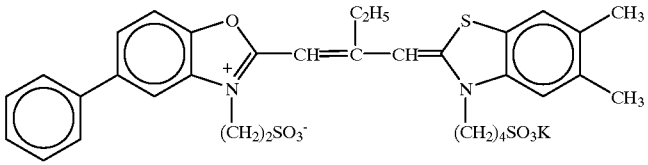
ExS-5
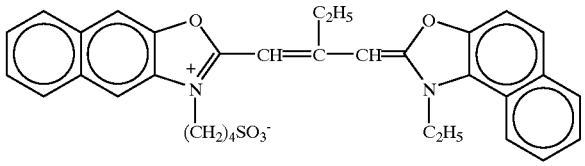
ExS-6
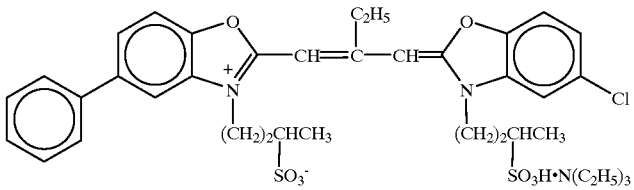
ExS-7
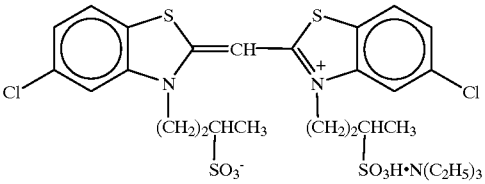
S-1
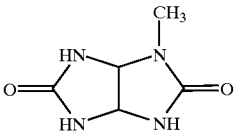
H-1
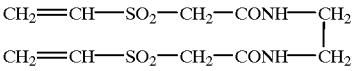
B-1
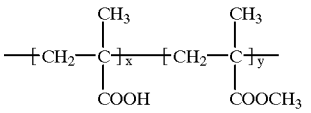
$x/y = 10/90$
B-2
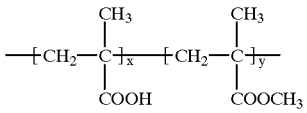
$x/y = 40/60$
B-3
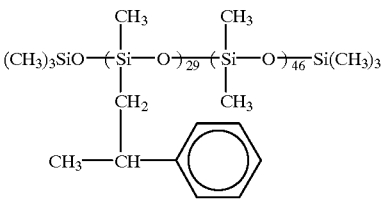

-continued
B-4
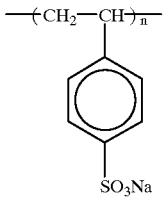
B-5
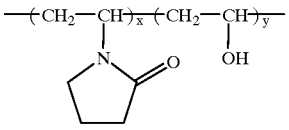
x/y = 70/30
B-6
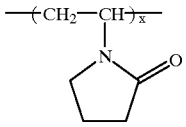
Molecular weight = approx. 10,000
W-1
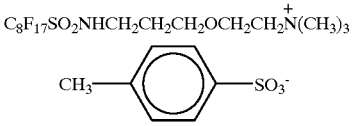
W-2
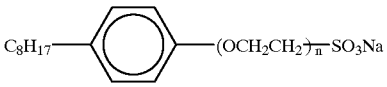
n = 2-4
W-3
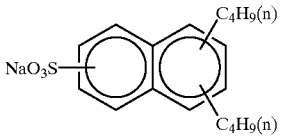
F-1
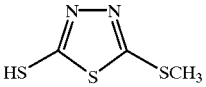
F-2
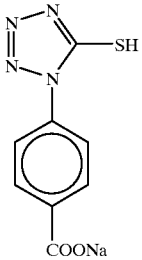
F-3
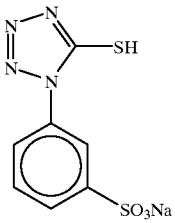
F-4
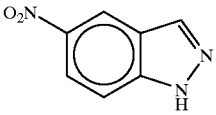
F-5
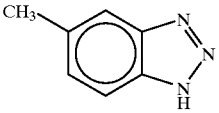
F-6
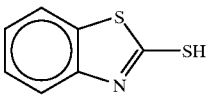
F-7
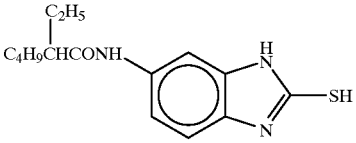
F-8
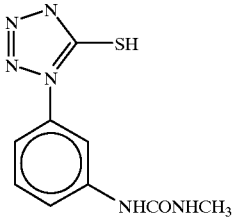
F-9
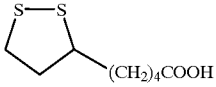
F-10
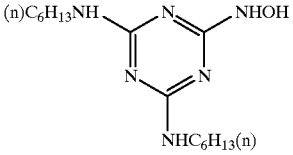

-continued

F-11

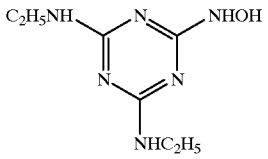

F-12

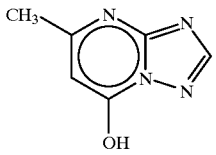

F-13

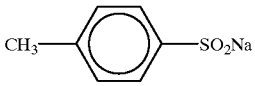

F-14

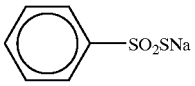

F-15

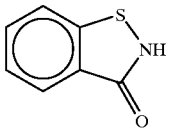

F-16

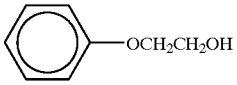

F-17

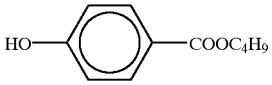

The following examples are given to further illustrate the present invention.

(1) Anticurl Properties (ANSI curl value)

A sample film of 120 mm (longitudinal direction of a base film)×35 mm (transverse direction of the base film) in size is cut out from a base film, wound to a 7 mm diameter roll, fixed temporarily not to be wound back, heated at 80° C. for 2 hours, let off from the roll and immersed in distilled water at 40° C. for 15 minutes. Thereafter, a load of 33 g is applied to the sample, and the sample is suspended vertically and heated at 55° C. for 3 minutes. The sample which remains curled is measured in accordance with the test method A described in ANSI PH 1.29-1971, and its curl value in terms of meter is calculated as an index for anticurl properties.

(2) Haze Value

This is a total haze value per film measured by a commercially available haze meter in accordance with JIS K-6714.

(3) Young's Modulus

A sample film measuring 150 mm (longitudinal direction of a base film)×10 mm (transverse direction of the film) is cut out from a base film, pulled by an Instron type universal tensile tester at chuck intervals of 100 mm, a pulling rate of 10 mm/min and a chart rate of 500 mm/min. Young's modulus is calculated from a tangent at a rising portion of the obtained load-elongation curve.

(4) Endothermic Peak Temperature TK (° C.)

10 mg of a film is set in the SSC5200 DSC 220 thermal analysis system (differential scanning calorimeter) supplied by Seiko Instruments Inc. and heated at a temperature elevation rate of 20° C./min in a nitrogen gas stream to analyze the endothermic behavior of the film by primary and secondary differentiation to determine a temperature showing a endothermic peak as an endothermic peak temperature.

(5) Glass Transition Temperature Tg (° C.)

10 mg of a film is molten at 330° C. for 5 minutes, set in the SSC5200 DSC 220 thermal analysis system (differential scanning calorimeter) supplied by Seiko Instruments Inc. and heated at a temperature elevation rate of 20° C./min in a nitrogen gas stream as in (4) above. This is a temperature at a middle point of an area where a discontinuity appears in a base line.

(6) Endothermic Energy ΔHK (mJ/mg)

10 mg of a film is set in the SSC5200 DSC 220 thermal analysis system (differential scanning calorimeter) supplied by Seiko Instruments Inc. and heated at a temperature elevation rate of 20° C./min in a nitrogen gas stream, as in (4) above. The endothermic energy is obtained from an area on the endothermic side of a DSC chart corresponding to the endothermic energy of the film. In the DSC chart, a peak line shifts to an endothermic side from the base line by elevating temperature, passes an endothermic peak by further elevating temperature and returns to the base line position. A straight line is drawn from the position of an endothermic start temperature to the position of an endothermic end temperature. An area encircled by the peak line and the straight line is the above area (A). Indium is measured under the same DSC measurement conditions to obtain an area (B), and the endothermic energy is obtained from the following equation based on the condition that the endothermic energy of the area (B) is 28.5 mJ/mg.

$$(A/B)\times 28.5=\Delta HK\ (mJ/mg)$$

(7) Folded Line Delamination Whitening Ratio

A film is cut out to a size of 80 mm×80 mm and folded into two by hand, and the fold is sandwiched between a pair of flat metal plates and pressed by a press machine at a predetermined pressure P1 (kg/cm$^2$G) for 20 seconds. After pressing, the folded film is unfolded by hand to restore its original state, sandwiched between the metal plates again and pressed at a pressure P1 (kg/cm$^2$G) for 20 seconds. Thereafter, the sample is taken out from the press machine and the lengths of whitened portions appearing on the folded line are measured and totaled.

The above measurement is repeated, using new film samples, to obtain the lengths of whitened portions appearing on the folded line when they are pressed at pressures P1 of 1, 2, 3, 4, 5 and 6 kg/cm$^2$G.

The ratio of the average value of the total lengths of whitened portions at each pressure to the total length of the folded line is taken as a folded line delamination whitening ratio. This value is used as an index for the probability of delamination (interlaminar peeling) of a film.

(folded line delamination whitening ratio (%))=((total of lengths of whitened portions (mm))/(80 mm×6))×100

(8) Intrinsic Viscosity

This is measured in a mixture solvent of phenol and tetrachloroethane (weight ratio of 6:4) at 35° C.

(9) Amount of Oxybenzoic Acid Copolymerized

A polyester is decomposed by the methanolysis and the quantity of the obtained oxybenzoic acid methyl ester is determined by gas chromatography.

(10) Content of Diethylene Glycol (DEG)

A polyester is decomposed using hydrazine hydrate and its quantity is determined by gas chromatography. The details of the measurement are the same as in the measurement of the amount of oxybenzoic acid copolymerized.

EXAMPLE 1

A copolyester (comprising ethylene-2,6-naphthalene dicarboxylate units in a proportion of 95.0 mol % and bis(4-(2-oxyethoxy)phenyl)sulfone-2,6-naphthalene dicarboxylate units (to be abbreviated as BPS-EO in the Tables) in a proportion of 5.0 mol % and having an intrinsic viscosity of 0.62) was used as a starting material. 0.005% by weight of silica particles having an average particle diameter of 0.3 μm were contained in the starting material. This starting material was dried and extruded by a melt extruder to obtain an unstretched film. This unstretched film was stretched to 3.0 times in a longitudinal direction (extrusion direction of the film) and 3.1 times in a transverse direction (transverse direction of the film) consecutively and then, heated to obtain a 75 μm thick biaxially oriented film. After the heat treatment, the biaxially oriented film was released from the chucks in the transverse direction and, while maintaining a stretch state in the longitudinal direction, brought into contact with a cooling roll to be quenched and then wound to a roll. The obtained biaxially oriented film was slit to a width of 500 mm and wound to a 165 mm diameter roll to prepare a 500 m long sample roll. In this state, the sample roll was annealed by elevating temperature from room temperature to 110° C. for 24 to 72 hours, maintaining the temperature at 110° C. over 24 hours and then reducing the temperature to room temperature over 24 to 72 hours to obtain a 75 μm thick biaxially oriented film. The characteristic properties of the obtained film were excellent as shown in Table 2.

EXAMPLE 2

A base film was prepared in the same manner as in Example 1 except that the film was stretched to 2.2 times in a longitudinal direction and to 3.2 times in a transverse direction and heated at 220° C. The characteristic properties of the obtained base film were excellent as shown in Table 2.

EXAMPLE 3

A base film w as prepared in the same manner as in Example 1 except that a copolyester (comprising ethylene-2,6-naphthalene dicarboxylate units in a proportion of 93.0 mol % and bis(4-(2-oxyethoxy)phenyl)sulfone-2,6-naphthalene dicarboxylate units in a proportion of 7.0 mol % and having an intrinsic viscosity of 0.61) pellets were used as a starting material. The characteristic properties of the obtained base film were excellent as shown in Table 2.

EXAMPLE 4

A base film was prepared in the same manner as in Example 1 except that a copolyester (comprising ethylene-2,6-naphthalene dicarboxylate units in a proportion of 97.0 mol % and bis(4-(2-oxyethoxy)phenyl)sulfone-2,6-naphthalene dicarboxylate units in a proportion of 3.0 mol % and having an intrinsic viscosity of 0.61) pellets were used as a starting material. The characteristic properties of the obtained base film were excellent as shown in Table 2.

TABLE 2

| | | Ex. 1 | Ex. 2 | Ex. 3 | Ex. 4 |
|---|---|---|---|---|---|
| Copolymerization | Copolymerizable component | BPS-EO | BPS-EO | BPS-EO | BPS-EO |
| | Molar ratio | 5.0 | 5.0 | 7.0 | 3.0 |
| Film formation | Stretch ratio | | | | |
| conditions | longitudinal direction | 3.0 | 2.2 | 3.0 | 3.0 |
| | transverse direction | 3.1 | 3.2 | 3.1 | 3.1 |
| | Heat setting temperature (°C.) | 225 | 220 | 220 | 230 |
| Heat treatment | Treatment temperature (°C.) | 110 | 110 | 110 | 110 |
| conditions | Treatment time (hr) | 24 | 24 | 24 | 24 |
| Film properties | Thickness (μm) | 75 | 75 | 75 | 75 |
| | Glass translation temperature | 123 | 123 | 124 | 121 |
| | Endothermic peak temperature | 135 | 135 | 134 | 136 |
| | Endothermic energy (mJ/mg) | 1.0 | 1.2 | 1.3 | 0.9 |
| | Young's modulus | | | | |
| | longitudinal direction (kg/mm$^2$) | 510 | 450 | 450 | 520 |
| | transverse direction (kg/mm$^2$) | 510 | 530 | 480 | 540 |
| | Haze (%) | 0.7 | 0.7 | 0.6 | 0.8 |
| | Folded line Delamination whitening ratio (%) | 0 | 0 | 0 | 0 |
| | Anticurl properties (l/m) | 18 | 10 | 11 | 22 |
| Overall evaluation | | ○ | ○ | ○ | ○ |

Ex.: Example
Comp. Ex.: Comparative Example

COMPARATIVE EXAMPLE 1

A base film was prepared in the same manner as in Example 1 except that a copolyester (comprising ethylene-2,6-naphthalene dicarboxylate units in a proportion of 99.9 mol % and bis(4-(2-oxyethoxy)phenyl)sulfone-2,6-naphthalene dicarboxylate units in a proportion of 0.1 mol % and having an intrinsic viscosity of 0.61) pellets were used as a starting material. The characteristic properties of the obtained base film are shown in Table 3.

COMPARATIVE EXAMPLE 2

A base film was prepared in the same manner as in Example 1 except that the stretch ratio in a longitudinal direction was changed to 5.0 times and the stretch ratio in a transverse direction was changed to 5.1 times. The characteristic properties of the obtained base film are shown in Table 3.

COMPARATIVE EXAMPLE 3

A base film was prepared in the same manner as in Example 1 except that annealing under such conditions that the temperature was elevated to 110° C. over 24 to 72 hours, maintained at 110° C. for 24 hours and reduced to room temperature over 24 to 72 hours was not carried out. The characteristic properties of the obtained base film are shown in Table 3.

COMPARATIVE EXAMPLE 4

A base film was prepared in the same manner as in 30 Example 1 except that a copolyester (comprising ethylene-2,6-naphthalene dicarboxylate units in a proportion of 95.0 mol % and 2,2-bis(4-(2-oxyethoxy)phenyl)propane-2,6-naphthalene dicarboxylate (to be abbreviated as BPA-EO in the Table 3) units in a proportion of 5.0 mol % and having an intrinsic viscosity of 0.61) pellets were used as a starting material. The characteristic properties of the obtained base film are shown in Table 3.

COMPARATIVE EXAMPLE 5

A base film was prepared in the same manner as in Example 1 except that a copolyester (comprising ethylene-2,6-naphthalene dicarboxylate units in a proportion of 95.0 mol % and diethylene-2,6-naphthalene dicarboxylate units in a proportion of 5.0 mol % and having an intrinsic viscosity of 0.60) pellets were used as a starting material. The characteristic properties of the obtained base film are shown in Table 3.

COMPARATIVE EXAMPLE 6

A base film was prepared in the same manner as in Example 1 except that a copolyester (comprising ethylene-2,6-naphthalene dicarboxylate units in a proportion of 95.0 mol % and ethylene terephthalate (to be abbreviated as DMT in the Table 3) units in a proportion of 5.0 mol % and having an intrinsic viscosity of 0.61) pellets were used as a starting material. The characteristic properties of the obtained base film are shown in Table 3.

TABLE 3

| | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| Copolymerization | Copolymerizable component | BPS-EO | BPS-EO | BPS-EO | BPA-EO | DEG | DMT |
| | Molar ratio | 0.1 | 5.0 | 5.0 | 5.0 | 5.0 | 5.0 |
| Film formation | Stretch ratio | | | | | | |
| conditions | longitudinal direction | 3.0 | 5.0 | 3.0 | 3.0 | 3.0 | 3.0 |
| | transverse direction | 3.1 | 5.1 | 3.1 | 3.1 | 3.1 | 3.1 |
| | Heat setting temperature (°C.) | 230 | 225 | 225 | 225 | 225 | 225 |
| Heat treatment | Treatment temperature (°C.) | 110 | 110 | — | 110 | 110 | 110 |
| conditions | Treatment time (hr) | 24 | 24 | — | 24 | 24 | 24 |
| Film properties | Thickness (μm) | 75 | 75 | 75 | 75 | 75 | 75 |
| | Glass translation temperature | 120 | 123 | 123 | 120 | 113 | 115 |
| | Endothermic peak temperature | 139 | 135 | — | 134 | 130 | 132 |
| | Endothermic energy (mJ/mg) | 0.7 | 0.2 | — | 1.0 | 1.0 | 1.0 |
| | Young's modulus | | | | | | |
| | longitudinal direction (kg/mm$^2$) | 640 | 630 | 510 | 510 | 540 | 560 |
| | transverse direction (kg/mm$^2$) | 640 | 630 | 510 | 520 | 550 | 580 |
| | Haze (%) | 0.9 | 0.7 | 0.7 | 0.7 | 0.7 | 0.7 |
| | Folded line Delamination whitening ratio (%) | 50 | 30 | 0 | 0 | 0 | 0 |
| | Anticurl properties (l/m) | 45 | 50 | 90 | 50 | 53 | 51 |
| Overall evaluation | | X | X | X | X | X | X |

Ex.: Example
Comp. Ex.: Comparative Example

EXAMPLE 5

100 Parts of naphthalene-2,6-dimethyl dicarboxylate and 60 parts of ethylene glycol were subjected to an ester exchange reaction by a commonly used method using 0.03 part of a manganese acetate tetrahydrate salt as an ester exchange catalyst, and then 0.023 part of trimethyl phosphate was added to terminate the ester exchange reaction.

Further, 2.83 parts of p-oxybenzoic acid (5 mol % based on naphthalene-2,6-dimethyl dicarboxylate) and 0.024 part of antimony trioxide were added and a polycondensation reaction was carried out by a commonly used method at a high temperature and a high vacuum to obtain a copolyethylene naphthalene dicarboxylate having an intrinsic viscosity of 0.62 dl/g and comprising 1.5 mol % of DEG copolymerized.

This copolyethylene naphthalene dicarboxylate pellets were dried at 180° C. for 3 hours, supplied to the hopper of an extruder, molten at a temperature of 300° C., and extruded over a rotary cooling drum having a surface temperature of 40° C. through a 1 mm slit die to obtain an unstretched film. The thus obtained unstretched film was preheated at 120° C., further heated between low-speed and high-speed rolls from 15 mm above with an IR heater at 900° C. to be stretched to 3.0 times in a longitudinal direction, and supplied to a stenter to be stretched to 3.3 times in a transverse direction at 140° C. The obtained biaxially oriented film was heat set at 210° C. for 5 seconds to obtain a 75 μm thick copolyethylene naphthalene dicarboxylate film.

The obtained film was heated at 110° C. for 2 days and measured for its properties. As shown in Table 4, it was satisfactory as a base film for photographic films.

REFERENCE EXAMPLES 1 AND 2, AND EXAMPLE 6

Biaxially oriented films were obtained in the same manner as in Example 5 except the amount of p-oxybenzoic acid was changed as shown in Table 4. The characteristic properties of the obtained films are shown in Table 4. They were satisfactory as a base film for photographic films like Example 5.

COMPARATIVE EXAMPLE 7

A biaxially oriented film was obtained in the same manner as in Example 5 except that p-oxybenzoic acid was not added. The characteristic properties of the obtained film are shown in Table 4. The film was unsatisfactory in terms of delamination resistance and anticurl properties.

COMPARATIVE EXAMPLES 8 AND 9

Biaxially oriented films were obtained in the same manner as in Example 5 except that the amount of p-oxybenzoic acid was changed as shown in Table 4, that is, to more than 7 mol %. The characteristic properties of the obtained films are shown in Table 4. The films were satisfactory in delamination resistance but unsatisfactory in Young's modulus and anticurl properties.

COMPARATIVE EXAMPLES 10 AND 11

A biaxially oriented film (Comparative Example 10) was obtained in the same manner as in Example 5 except that 2 parts of DEG was added. The amount of DEG copolymerized contained in the copolyester was 4 mol %.

A biaxially oriented film (Comparative Example 11) was obtained in the same manner as in Example 5 except that DEG was not added and a polymerization reaction was carried out at a normal pressure for 20 minutes after the addition of antimony trioxide. The amount of DEG copolymerized contained in the copolyester was 4 mol %. This DEG was produced as a by-product of the polymerization reaction and contained as a copolymerizable component. The characteristic properties of the obtained films are shown in Table 4.

When the amount of DEG was more than 3 mol %, even if the same oxybenzoic acid as in Example 5 was copolymerized, Young's modulus and anticurl properties were unsatisfactory.

TABLE 4

| | Proportion of p-oxybenzoic acid co-polymerized (mol %) | Content of DEG (mol %) | Intrinsic viscosity (dl/g) | Delamination whitening ratio (%) | Anticurl properties ANSI curl value ($m^{-1}$) | Young's modulus (MD/TD) ($kg/mm^2$) |
|---|---|---|---|---|---|---|
| Ex. 5 | 5.0 | 1.5 | 0.62 | 0 | 30 | 605/620 |
| Ref. Ex. 1 | 3.0 | 1.4 | 0.61 | 2 | 24 | 612/623 |
| Ref. Ex. 2 | 1.5 | 1.5 | 0.62 | 5 | 23 | 620/631 |
| Ex. 6 | 6.5 | 1.6 | 0.60 | 0 | 38 | 596/602 |
| Comp. Ex. 7 | 0 | 1.3 | 0.62 | 30 | 32 | 615/632 |
| Comp. Ex. 8 | 7.5 | 1.5 | 0.60 | 0 | 55 | 520/535 |
| Comp. Ex. 9 | 10 | 1.8 | 0.60 | 0 | 58 | 476/490 |
| Comp. Ex. 10 | 5.0 | 4.0 | 0.61 | 15 | 61 | 440/452 |
| Comp. Ex. 11 | 2.0 | 4.0 | 0.62 | 20 | 56 | 485/498 |

Ex.: Example
Comp. Ex.: Comparative Example

What is claimed is:

1. A base film for a photographic film, (A) which is formed from a copolyester comprising:

97 to 100 mol % of 2,6-naphthalenedicarboxylic acid and 0 to 3 mol % of a dicarboxylic acid other than 2,6-naphthalenedicarboxylic acid, based on the total of all dicarboxylic acid components, and 87 to 99.8 mol % of ethylene glycol, 0.2 to 10 mol % of bis[4-(ω-hydroxyalkoxy)phenyl]sulfone represented by the following formula (1):

(1)

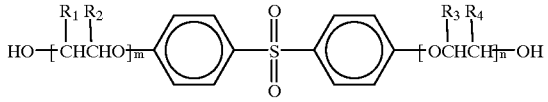

wherein $R_1$, $R_2$, $R_3$ and $R_4$ are each a hydrogen atom or an alkyl group having 1 to 3 carbon atoms, and m and n are independently an integer of 1 to 5, provided that $R_1$ and $R_2$, or $R_3$ and $R_4$ cannot be an alkyl group having 1 to 3 carbon atoms at the same time, and 0 to 3 mol % of a glycol other than ethylene glycol and the compound represented by the above formula (1), based on the total of all diol components; and (B) which has an endothermic peak having a peak top temperature, measured by a differential scanning calorimeter, of 120 to 160° C. and showing an endothermic energy of 0.3 mJ/mg or more.

2. The base film of claim 1 which comprises bis[4-(ω-hydroxyalkoxy)phenyl]sulfone of the above formula (1) in which $R_1$, $R_2$, $R_3$ and $R_4$ are all a hydrogen atom.

3. The base film of claim 1 which comprises bis[4-(β-hydroxyethoxy)phenyl]sulfone of the above formula (1) in which $R_1$, $R_2$, $R_3$ and $R_4$ are all a hydrogen atom, and m and n are 1.

4. The base film of claim 1, wherein the proportion of bis[4-(ω-hydroxyalkoxy)phenyl]sulfone component of the above formula (1) in the copolymer is more than 3.0 mol % but 8 mol % or less.

5. The base film of claim 1, wherein the total proportion of the dicarboxylic acid component other than 2,6-naphthalenedicarboxylic acid and the glycol component other than ethylene glycol and the compound represented by the above formula (1) in the copolymer is 3 mol % or less.

6. The base film of claim 1 which has an endothermic peak showing an endothermic energy of 0.5 to 5 mJ/mg.

7. The base film of claim 1, wherein the copolyester has a glass transition temperature lower than 125° C.

8. A base film for a photographic film, (A') which is formed from a copolyester comprising:

97 to 100 mol % of 2,6-naphthalenedicarboxylic acid and 0 to 3 mol % of a dicarboxylic acid other than 2,6-naphthalenedicarboxylic acid, based on the total of all dicarboxylic acid components, 97 to 100 mol % of ethylene glycol and 0 to 3 mol % of a diol other than ethylene glycol, based on the total of all diol components, and more than 3.0 mol % but 6.5 mol % or less of an oxycarboxylic acid represented by the following formula (2) based on the total of all dicarboxylic acid components:

(2)

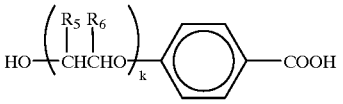

wherein $R_5$ and $R_6$ are each a hydrogen atom or an alkyl group having 1 to 3 carbon atoms, and k is an integer of 0 to 5, provided that $R_5$ and $R_6$ cannot be an alkyl group having 1 to 3 carbon atoms at the same time;

and (B) wherein said base film has an endothermic peak having a peak top temperature, measured by a differential scanning calorimeter, of 120 to 160° C. and showing an endothermic energy of 0.3 mJ/mg or more.

9. The base film of claim 8 which comprises an oxycarboxylic acid of the above formula (2) in which $R_5$ and $R_6$ are each a hydrogen atom.

10. The base film of claim 8 which comprises an oxycarboxylic acid of the above formula (2) in which k is 0.

11. The base film of claim 8, wherein the glycol other than ethylene glycol is diethylene glycol.

12. The base film of claim 8, wherein the total proportion of the dicarboxylic acid component other than 2,6-naphthalenedicarboxylic acid and the glycol component other than ethylene glycol in the copolymer is 3 mol % or less.

13. The base film of claim 12, wherein the endothermic energy is 0.5 to 5 mJ/mg.

14. The base film of claim 8, wherein the copolyester has a glass transition temperature lower than 125° C.

15. The base film of claim 1 or 8 which has an ANSI curl value measured at 80° C. of 40 $m^{-1}$ or less.

16. The base film of claim 1 or 8 which has a folded line delamination whitening ratio of 5% or less.

17. The base film of claim 1 or 8, wherein at least one direction in which the Young's modulus is 400 to 750 $kg/mm^2$ is present within the film plane.

18. The base film of claim 1 or 8 which has a thickness of 40 to 120 μm.

19. A photographic film comprising the base film of claim 1 or 8 and a photosensitive layer formed on this base film.

20. A base film for a photographic film, (A) which is formed from a copolyester comprising:

97 to 100 mol % of 2,6-naphthalenedicarboxylic acid and 0 to 3 mol % of a dicarboxylic acid other than 2,6-naphthalenedicarboxylic acid, based on the total of all dicarboxylic acid components, and 87 to 99.8 mol % of ethylene glycol, 0.2 to 10 mol % of bis[4-(ω-hydroxyalkoxy)phenyl]sulfone represented by the following formula (1):

(1)

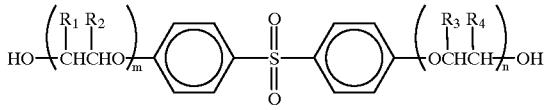

wherein $R_1$, $R_2$, $R_3$ and R4 are each a hydrogen atom or an alkyl group having 1 to 3 carbon atoms, and m and n are independently an integer of 1 to 5, provided that $R_1$ and $R_2$, or $R_3$ and $R_4$ cannot be an atkyl group having 1 to 3 carbon atoms at the same time;

and 0 to 3 mol % of a glycol other than ethylene glycol and the compound represented by the above formula (1), based on the total of all diol components;

(B) which has an endothermic peak having a peak top temperature, measured by a differential scanning calorimeter, of 120 to 160° C. and showing an endothermic energy of 0.3 mJ/mg or more; and (C) wherein said base film is annealed at a temperature of 100 to 115° C. for 10 minutes to 100 hours.

21. A base film for a photographic film, (A') which is formed from a copolyester comprising:

97 to 100 mol % of 2,6-naphthalenedicarboxylic acid and 0 to 3 mol % of a dicarboxylic acid other than 2,6-naphthalenedicarboxylic acid, based on the total of all dicarboxylic acid components, 97 to 100 mol % of ethylene glycol and 0 to 3 mol % of a diol other than ethylene glycol, based on the total of all diol components, and more than 3.0 mol % but 6.5 mol % or less of an oxycarboxylic acid represented by the following formula (2) based on the total of all dicarboxylic acid components:

(2)

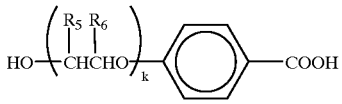

wherein $R_5$ and $R_6$ are each a hydrogen atom or an alkyl group having 1 to 3 carbon atoms, and k is an integer of 0 to 5, provided that $R_5$ and $R_6$ cannot be an alkyl group having 1 to 3 carbon atoms at the same time;

(B) wherein said base film has an endothermic peak having a peak top temperature, measured by a differential scanning calorimeter, of 120 to 160° C. and showing an endothermic energy of 0.3 mJ/mg or more; and (C) wherein said base film is annealed at a temperature of 100 to 115° C. for 10 minutes to 100 hours.

* * * * *